US005800773A

United States Patent [19]

Beveridge et al.

[11] Patent Number: 5,800,773

[45] Date of Patent: Sep. 1, 1998

[54] SEGMENTED SMELT SPOUT

[75] Inventors: Christopher J. Beveridge, Orleans; Andrew K. Jones, Gloucester, both of Canada

[73] Assignee: Combustion Engineering, Inc., Windsor, Conn.

[21] Appl. No.: 770,465

[22] Filed: Dec. 20, 1996

[30] Foreign Application Priority Data

Nov. 15, 1996 [CA] Canada ..... 2119963

[51] Int. Cl.[6] ..... C21C 5/42

[52] U.S. Cl. ..... 266/236; 222/592; 266/270

[58] Field of Search ..... 266/236, 196, 266/218, 270; 222/590, 592

[56] References Cited

U.S. PATENT DOCUMENTS 4,011,047 3/1977 Tremblay ..... 266/218

4,750,649 6/1988 Fahey et al. ..... 222/592

5,437,768 8/1995 Smith et al. ..... 222/592

5,667,201 9/1997 Beveridge et al. ..... 266/196

*Primary Examiner*—Scott Kastler

*Attorney, Agent, or Firm*—Arthur E. Fournier, Jr.

[57] ABSTRACT

A segmented smelt spout comprising an assembly of different casting shapes wherein one shape constitutes the base segment, which is installable in a chemical recovery unit, and the other shapes are a combination of straight and curved cast segments, which can be used in different combinations to obtain varying spout angles and lengths with the latter segments being supported off the base segment and being held together by a tensioning means that maintains contact between the mating surfaces of each segment while permitting each individual segment to expand and contract thermally.

14 Claims, 6 Drawing Sheets

SEGMENTED SMELT SPOUT

BACKGROUND OF THE INVENTION

This invention relates generally to chemical recovery units, and more specifically, to a smelt spout that is particularly suited for use in a chemical recovery unit for the purpose of effecting therewith the discharge from the chemical recovery unit of smelt, which is comprised of non-burnable chemicals and which is produced during the course of the operation of the chemical recovery units.

Chemical recovery units are steam generators, the furnace of each of which is lined with steam generating tubes. Such chemical recovery units are employed in the pulp and paper industry wherein the so-called black liquor produced from the Kraft pulping process is introduced into the furnace of the chemical recovery unit whereby the combustible, i.e., burnable, materials, which the black liquor embodies, are burned in the furnace of the chemical recovery unit and whereby the non-burnable chemicals, which the black liquor embodies, are smelted and as such can be recovered.

In accordance with the mode of operation of such chemical recovery units the black liquor is sprayed into the furnace of the chemical recovery unit at a location spaced well above the bottom of the furnace. This black liquor has a substantial moisture content and most of this moisture is driven from the black liquor spray upon the introduction of the black liquor into the furnace of the chemical recovery unit because of the high temperature in the furnace and the hot gases passing upwardly through the furnace and the spray. The solids in the black liquor that remain after thus removing the moisture from the black liquor fall onto the bottom, i.e., hearth, of the furnace of the chemical recovery unit and form thereat a roughly truncated pile. During the descent to the hearth of the furnace some of the lighter volatiles are driven from these solids from which the aforementioned roughly truncated pile is formed, and the remaining volatiles from these solids are liberated and the combustible materials in these solids are burned in the aforementioned roughly truncated pile with this combustion being supported by the introduction of primary air at locations spaced somewhat above the bottom, i.e., hearth, of the furnace of the chemical recovery unit. This air is introduced through ports such that this air is directed generally over and upon the aforementioned roughly truncated pile of solids. Some burnables, i.e., combustible materials, in these solids are carried up through the furnace of the chemical recovery unit and are consumed above the location at which the black liquor is introduced into the furnace of the chemical recovery unit with secondary air being introduced into the furnace of the chemical recovery unit for this purpose, i.e., to effect therewith the consumption, i.e., combustion, of these solids. The non-burnable chemicals, which the black liquor embodies, are on the other hand smelted and periodically withdrawn from the furnace of the chemical recovery unit by means of a smelt spout. It is to such a smelt spout that the subject matter of the instant application is directed.

It has long been known in the prior art to provide smelt spouts that are suitable for use in a chemical recovery unit for the purpose of effecting therewith the discharge of smelt from the furnace of the chemical recovery unit. By way of exemplification and not limitation, one example of a prior art form of smelt spout that has heretodate been intended for utilization in a chemical recovery unit for the purpose of effecting therewith the discharge of smelt from the furnace of the chemical recovery unit is that which forms the subject matter of Canadian Patent No. 1,235,863 entitled "Steam Cooled Spout," which issued on May 3, 1988. In accordance with one aspect of the teachings of Canadian Patent No. 1,235,863, there is provided a substantially energy saving steam cooled spout that offers reduced explosion hazards. This substantially energy saving steam cooled spout includes a substantially heat resistant heat exchanging metallic wall, defining a spout for receiving and conveying a smelt and contacting the smelt against one surface of the heat exchanging metallic wall. A second heat resistant wall joins the heat exchanging metallic wall on the opposite surface of the heat exchanging metallic wall. The second heat resistant wall with the opposite surface of the heat exchanging metal wall defines a passage for a flow of steam along the heat exchanging metallic wall. A plurality of baffle means are mounted within the aforedescribed passage. The plurality of baffle means join the heat exchanging metallic wall to the second heat resistant wall so as to thus define a tortuous path in order to thereby increase the path of the steam over the heat exchanging metallic wall for the purpose of raising the temperature of the steam. To this end, the tortuous path is designed to be operative to boost the temperature of the steam in order for the steam to be in a superheated condition, while at the same time cooling the heat exchanging metallic wall and thereby the smelt, and reducing the stress caused on the heat exchanging metallic wall by the molten smelt. The aforedescribed passage at the outlet end thereof is provided with means for directing the flow of steam in its superheated condition into the flow of molten smelt. The steam being in a superheated condition has minimum explosive expansion characteristics when in contact with the molten smelt.

Another example, by way of exemplification and not limitation, of a prior art form of smelt spout that has heretodate been intended for utilization in a chemical recovery unit for the purpose of effecting therewith the discharge of smelt from the furnace of the chemical recovery unit is that which forms the subject matter of Japanese Patent Document No. 03287890, which was published on Dec. 18, 1991. In accordance with the teachings of Japanese Patent Document No. 03287890, there is provided a smelt spout that includes a first portion, which is designed to be contacted by the smelt, and a second portion within which the aforementioned first portion is designed to be supported. The first portion comprises a heat resistant and anticorrosive Cr—Ni based alloy. The second portion comprises either one or both of the following: a heat insulating and fire resisting layer, and an alumina based ceramic layer. In the case where both of the aforedescribed layers are employed, the alumina based ceramic layer is preferably interposed between the Cr—Ni based alloy and the heat insulating and fire resisting layer.

Still another example, by way of exemplification and not limitation, of a prior art form of smelt spout that has heretodate been intended for utilization in a chemical recovery unit for the purpose of effecting therewith the discharge of smelt from the furnace of the chemical recovery unit is that which forms the subject matter of U.S. Pat. No. 4,011,047 entitled "Smelt Spout For Recovery Boiler," which issued on Mar. 8, 1977. In accordance with the teachings of U.S. Pat. No. 4,011,047, there is provided a non-water cooled smelt spout for a pulp mill chemical recovery furnace. The aforesaid smelt spout includes a metal trough having bottom and side walls. A lining is provided in the metal trough for purposes of isolating the smelt from the trough. The metal trough includes an end wall formed at the free, i.e., front, end thereof. Immediately adjacent the bottom wall of the metal trough there is provided a stream jet means. The stream jet means is operative for directing steam away from the spout to intersect the trajectory of the smelt pouring from the smelt spout for purposes of causing the smelt to disintegrate.

Still a further example, by way of exemplification and not limitation, of a prior art form of smelt spout that has heretodate been intended for utilization in a chemical recovery unit for the purpose of effecting therewith the discharge of smelt from the furnace of the chemical recovery unit is that which forms the subject matter of Japanese Patent Document No. 04343786, which was published on Nov. 30, 1992. In accordance with the teachings of Japanese Patent Document No. 04343786, there is provided for use in a chemical recovery boiler a smelt spout, which embodies a chute that is lined with blocks of ceramic. Preferably, the chute is made of an alloy containing more than 40% of Cr by weight, and the blocks of ceramic are made of alumina.

Yet another example, by way of exemplification and not limitation, of a prior art form of smelt spout that has heretodate been intended for utilization in a chemical recovery unit for the purpose of effecting therewith the discharge of smelt from the furnace of the chemical recovery unit is that which forms the subject matter of U.S. Pat. No. 5,437,768 entitled "Non-Baffled Low Pressure Drop Vacuum Cooled Inserted Smelt Spout," which issued on Aug. 1, 1995. In accordance with the teachings of U.S. Pat. No. 5,437,768, there is provided a low pressure drop insertable smelt spout for channeling smelt from the opening of the walls of the boiler. The subject smelt spout encompasses a jacket having an inner wall and an outer wall. The outer wall of the jacket is spaced a distance away from the inner wall of the jacket. The jacket, which has one end insertable into the opening of the wall of a boiler, defines a trough for carrying smelt from the boiler. Continuing, the subject smelt spout utilizes an inlet, which communicates with the jacket for delivering a water flow to the jacket between the inner wall thereof and the outer wall thereof. An O-shaped tube communicates with the jacket at the inserted end of the jacket in order to receive the water flow from between the inner wall of the jacket and the outer wall of the jacket. An outlet communicates with the O-shaped tube near the inserted end of the jacket for channeling the water flow from the O-shaped tube. Optionally, a vacuum system may be used in conjunction with the spout for allowing the water to flow through the jacket from the inlet between the walls of the jacket, and eventually to the O-shaped tube at the inserted end of the jacket.

Yet still another example, by way of exemplification and not limitation, of a prior art form of smelt spout that has heretodate been intended for utilization in a chemical recovery unit for the purpose of effecting therewith the discharge of smelt from the furnace of the chemical recovery unit is that which forms the subject matter of pending U.S. patent application Ser. No. 08/410,221 entitled "Smelt Spout For A Recovery Furnace," which was filed on Mar. 24, 1995. In accordance with one aspect of the invention as taught in U.S. patent application Ser. No. 08/410,221, there is provided a smelt spout for delivering smelt from a chemical recovery furnace. The subject smelt spout includes a trough embodying a U-shaped profile, and is fabricated as a casting of a nickel-chromium alloy. The U-shaped profile that the smelt spout embodies is defined by a curved lower portion that is relatively thick in the central region thereof, and which tapers in thickness towards the upstanding limbs that serve to define the upstanding leg portions of the U-shaped profile. The maximum thickness of the U-shaped profile is designed to be located in the area of the trough, which is most subject to wear.

Although smelt spouts intended for utilization in a chemical recovery unit for the purpose of effecting therewith the discharge of smelt from the furnace of the chemical recovery unit, such as those smelt spouts that are constructed in accordance with the teachings of those patent documents to which hereinabove reference has been had, have been available heretodate for utilization in chemical recovery units, a need has nevertheless still been evidenced in the prior art for a new and improved smelt spout that would be particularly suited for employment in a chemical recovery unit. More specifically, there has been evidenced in the prior art a need for a new and improved smelt spout that would be particularly characterized in a number of respects. To this end, one such characteristic which such a new and improved smelt spout would desirably possess is that the smelt spout would be non-cooled so as to thereby obviate any potential safety hazard that might be occasioned by virtue of the smelt coming into contact with a cooling medium, such as water that might be being used to effect therewith the cooling of the smelt spout. Another characteristic which such a new and improved smelt spout would desirably possess is that the nature of the construction of the smelt spout would provide for flexibility insofar as the selection of the spout exit angle is concerned. A third characteristic which such a new and improved smelt spout would desirably possess is that the nature of the construction of the smelt spout would provide for flexibility insofar as the selection of the length of the smelt spout is concerned. A fourth characteristic which such a new and improved smelt spout would desirably possess is that the nature of the construction of the smelt spout would provide for the smelt spout to be composed of relatively small pieces in order to thereby facilitate the handling thereof during installation of the smelt spout in a chemical recovery unit. A fifth characteristic which such a new and improved smelt spout would desirably possess is that the nature of the construction of the smelt spout would provide for selective replacement of portions of the smelt spout, such as those, for example, which are subjected to the highest wear, without necessitating that the entire smelt spout be replaced in order to effect the replacement of such portions of the smelt spout. A sixth characteristic which such a new and improved smelt spout would desirably possess is that the nature of the construction of the smelt spout would provide for the smelt spout to be composed of a plurality of segments, each being relatively short in length, for the purpose of being able to better handle the thermal gradients, which are experienced particularly between the inner and outer surfaces of the thickest portions of the smelt spout that are in contact with the smelt flow. A seventh characteristic which such a new and improved smelt spout would desirably possess is that the nature of the construction of the smelt spout would be such that the smelt spout would be suitable for incorporation as part of a new chemical recovery unit. An eighth characteristic which such a new and improved smelt spout would desirably possess is that the nature of the construction of the smelt spout would be such that the smelt spout would be suitable for retrofitting into existing chemical recovery units while at the same time still being suitable for incorporation as part of a new chemical recovery unit. A ninth characteristic which such a new and improved smelt spout would desirably possess is that the nature of the construction of the smelt spout would be such that the smelt spout would be easy to employ, would be reliable in operation, but which yet would be relatively inexpensive to provide.

It is, therefore, an object of the present invention to provide a new and improved smelt spout suitable for use to effect therewith the delivery of smelt from a chemical recovery unit.

It is another object of the present invention to provide such a new and improved smelt spout that is characterized in that the smelt spout is non-cooled so as to thereby obviate any potential safety hazard that might be occasioned by virtue of the smelt coming into contact with a cooling medium, such as water that might be being used to effect therewith the cooling of the smelt spout.

It is a further object of the present invention to provide such a new and improved smelt spout that is characterized in that the nature of the construction, which the smelt spout possesses, provides for flexibility insofar as the selection of the spout exit angle is concerned.

Another object of the present invention is to provide such a new and improved smelt spout that is characterized in that the nature of the construction, which the smelt spout possesses, provides for flexibility insofar as the selection of the length of the smelt spout is concerned.

A still another object of the present invention is to provide such a new and improved smelt spout that is characterized in that the nature of the construction, which the smelt spout possesses, provides for the smelt spout to be composed of relatively small pieces in order to thereby facilitate the handling thereof during installation of the smelt spout in a chemical recovery unit.

A further object of the present invention is to provide such a new and improved smelt spout that is characterized in that the nature of the construction, which the smelt spout possesses, provides for selective replacement of portions of the smelt spout, such as those, for example, which are subjected to the highest wear, without necessitating that the entire smelt spout be replaced in order to effect the replacement of such portions of the smelt spout.

A still further object of the present invention is to provide such a new and improved smelt spout that is characterized in that the nature of the construction, which the smelt spout possesses, provides for the smelt spout to be composed of a plurality of segments, each being relatively short in length, for the purpose of being able to better handle the thermal gradients, which are experienced particularly between the inner and outer surfaces of the thickest portions of the smelt spout that are in contact with the smelt flow.

Yet an object of the present invention is to provide such a new and improved smelt spout that is characterized in that the nature of the construction, which the smelt spout possesses, is such that the smelt spout is suitable for incorporation as part of a new chemical recovery unit.

Yet a further object of the present invention is to provide such a new and improved smelt spout that is characterized in that the nature of the construction, which the smelt spout possesses, is such that the smelt spout is suitable for retrofitting into existing chemical recovery units while at the same time still being suitable for incorporation as part of a new chemical recovery unit.

Yet another object of the present invention is to provide such a new and improved smelt spout that is characterized in that the nature of the construction, which the smelt spout possesses, is such that the smelt spout is easy to employ, is reliable in operation, but which yet is relatively inexpensive to provide.

SUMMARY OF THE PRESENT INVENTION

In accordance with the present invention there is provided a smelt spout that is particularly suited for use in a chemical recovery unit for the purpose of effecting therewith the discharge from the chemical recovery unit of smelt, which is composed of non-burnable materials and which is produced during the course of the operation of a chemical recovery unit. The subject smelt spout embodies a segmented construction. To this end, the subject segmented smelt spout comprises an assembly of segments of different shapes. Included in this assembly of segments of different shapes is a base segment. This base segment is designed so as to be suitable for effecting the installation of the subject segmented smelt spout in a chemical recovery unit. Also included in this assembly of segments of different shapes is a combination of straight and curved segments. This combination of straight and curved segments is designed to be supported off the base segment. Moreover, this combination of straight and curved segments is so designed so as to be capable of being employed in different combinations such that through the use of selected ones of this combination of straight and curved segments it is possible to obtain therewith varying smelt spout exit angles and varying smelt spout lengths. In addition, each individual segment of this combination of straight and curved segments is suitably dimensioned so as to be small enough to facilitate the handling thereof during installation of the segmented smelt spout in a chemical recovery unit and so as to be as well short enough in length in order to be able to thereby handle the thermal gradients, which are experienced particularly between the inner and the outer surfaces of the thickest portions of the segmented smelt spout that are in contact with the smelt flow. A further beneficial attribute of this combination of straight and curved segments is that the use thereof permits selective replacement of individual ones of this combination of straight and curved segments without necessitating the replacement of the entire segmented smelt spout in order to effect the replacement of individual ones of this combination of straight and curved segments. The subject segmented smelt spout constructed in accordance with the present invention additionally includes tensioning means operable for the purpose of holding this combination of straight and curved segments together when being employed in a given segmented smelt spout such that the mating surfaces thereof are maintained in contact with one another while at the same time permitting individual ones of this combination of straight and curved segments to expand and contract thermally. This tensioning means is also operable for holding together this combination of straight and curved segments and the base segment from which this combination of straight and curved segments is supported.

DESCRIPTION OF THE PREFERRED EMBODIMENT

Figure 1:
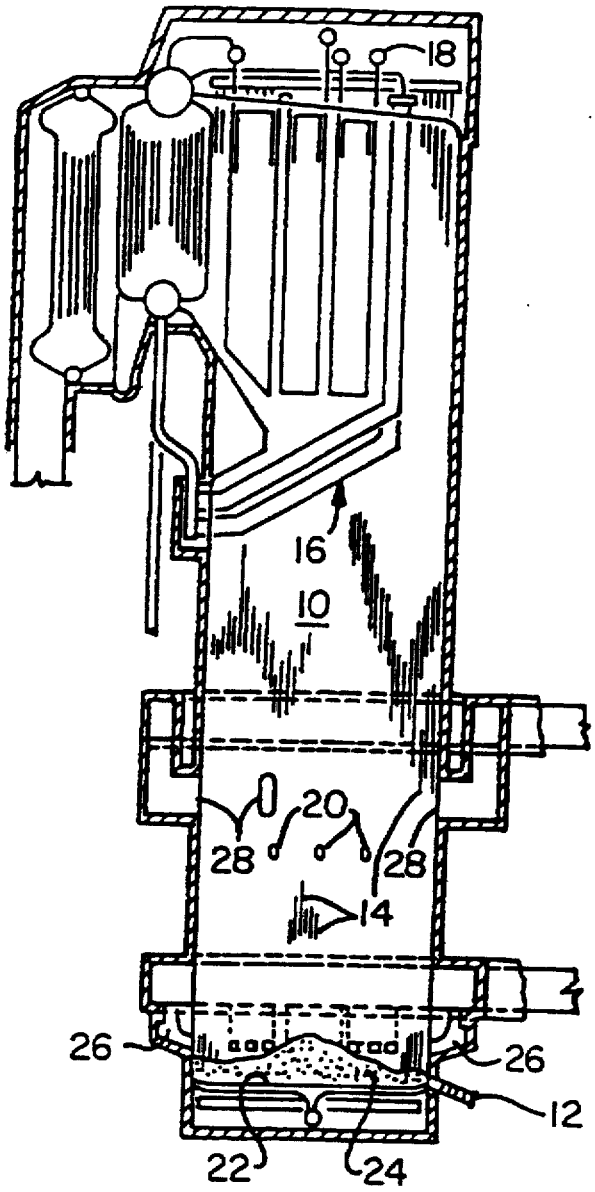
FIG. 1 is a sectional side view of a chemical recovery unit depicted embodying a segmented smelt spout constructed in accordance with the present invention.

Referring now to the drawing, and more particularly to FIG. 1 thereof, there is depicted therein a chemical recovery unit, generally designated by reference numeral 10. Inasmuch as the nature of the construction and the mode of operation of chemical recovery units per se are well-known to those skilled in the art, it is not deemed necessary, therefore, to set forth herein a detailed description of the chemical recovery unit 10 illustrated in FIG. 1. Rather, for purposes of obtaining an understanding of a chemical recovery unit 10, which is suitable for having installed therein a segmented smelt spout constructed in accordance with the present invention, be it the first embodiment thereof that is designated by the reference numeral 12 in FIG. 2 of the drawing or the second embodiment thereof that is designated by the reference numeral 12' in FIG. 9 of the drawing, and when so installed in the chemical recovery unit 10 is operative for the purpose of effecting therewith the discharge from the chemical recovery unit 10 of smelt, which is composed of non-burnable materials and which is produced during the course of the operation of the chemical recovery unit 10, it is deemed to be sufficient that there be presented herein merely a description of the nature of the components of the chemical recovery unit 10 with which the aforereferenced segmented smelt spout, be it the segmented smelt spout 12 or the segmented smelt spout 12', cooperates. For purposes of the description that follows herein of the chemical recovery unit 10, it should be noted that the chemical recovery unit 10 as illustrated in FIG. 1 of the drawing is depicted with the segmented smelt spout 12 installed therein. One may have reference to the prior art, e.g., U.S. Pat. No. 3,304,920, which issued Feb. 21, 1967 to E. C. Chapman, for a more detailed description of the nature of the construction and the mode of operation of the components of the chemical recovery unit 10, which are not described herein.

Referring further to FIG. 1 of the drawing, the chemical recovery unit 10 as illustrated therein includes walls that are lined with steam generating tubes, the latter being denoted by the reference numeral 14 in FIG. 1, which may be in generally tangent relation or may be in closely spaced relation with the space intermediate the tubes 14 being bridged by a fin. The tubes 14 form part of the heat exchange surface of the chemical recovery unit 10 with there being additional heat exchange surface identified generally as 16 in the upper region of the chemical recovery unit 10. The tubes 14 carry a mixture of steam and water at saturation temperature for the particular pressure at which the chemical recovery unit 10 is operated with this mixture passing upwardly through these tubes 12. The chemical recovery unit 10, which is illustrated in FIG. 1 of the drawing, is designed to be operative to produce steam at 950 pounds per square inch pressure with this steam being conveyed from the header, denoted by the reference numeral 18 in FIG. 1, to a desired point of use and with this steam being superheated to a desired value such as 900 degrees F.

Continuing with the description of the chemical recovery unit 10, which is illustrated in FIG. 1 of the drawing, residual liquor obtained from the Kraft pulping process is introduced into the chemical recovery unit 10 through the nozzles, denoted by the reference numeral 20 in FIG. 1. The residual liquor thus sprayed into the chemical recovery unit 10 descends downwardly toward the bottom, denoted by the reference numeral 22 in FIG. 1, of the chemical recovery unit 10 and in doing so passes through an upwardly rising stream of combustion gases such that a majority of the moisture in the residual liquor is immediately evaporated with the solid particles falling downwardly through this rising combustion gas stream and forming a pile, denoted by the reference numeral 24 in FIG. 1, on the hearth or bottom 22 of the chemical recovery unit 10. A portion of the burnables, which the aforementioned residual liquor embodies, are consumed during this descent through the chemical recovery unit 10 with additional burnables, which the aforementioned residual liquor embodies, being consumed on the pile 24 and with the non-burnable materials, which the aforementioned residual liquor embodies, being smelted and periodically withdrawn from the chemical recovery unit 10 through the segmented smelt spout 12 constructed in accordance with the present invention and to which further reference will be had hereinafter.

Completing for purposes of the instant application the description of the chemical recovery unit 10, which is illustrated in FIG. 1 of the drawing, combustion supporting air is introduced into the chemical recovery unit 10 at two locations. The primary air is introduced through nozzles, denoted by the reference numeral 26 in FIG. 1, that are spaced relatively close to the bottom 22 as, for example, three feet above the bottom 22 of the chemical recovery unit 10, while the secondary air is introduced through the nozzles or ports, denoted by the reference numeral 28 in FIG. 1, that are located above the nozzles 20 through which the residual liquor is introduced into the chemical recovery unit 10.

With the preceding by way of background, reference will now be had for purposes of the first embodiment of segmented smelt spout 12 particularly to FIGS. 2 through 8 of the drawing and for purposes of the second embodiment of segmented smelt spout 12' particularly to FIGS. 9 through 12 and 3 through 8, for purposes of describing the segmented smelt spouts 12 and 12' constructed in accordance with the present invention, which are designed so as to be installable in a chemical recovery unit 10, which is illustrated in FIG. 1 of the drawing and to which reference has been had hereinabove. More specifically, the segmented smelt spouts 12 and 12' are designed so as to be installable in a chemical recovery unit such as the chemical recovery unit 10 of FIG. 1 of the drawing so that when so installed therein the segmented smelt spouts 12 and 12' are operative for the purpose of effecting therewith the discharge from the chemical recovery unit 10 of smelt, which is composed of non-burnable materials and which is produced during the course of the operation of the chemical recovery unit 10.

As best understood with reference to FIGS. 2 through 8 of the drawing, the first embodiment of segmented smelt spout 12 comprises an assembly of segments of different shapes. To this end, the first embodiment of segmented smelt spout 12 comprises an assembly of segments that includes a base segment, denoted generally in FIG. 2 of the drawing by the reference numeral 30, that will be described hereinafter with reference to FIGS. 3, 4 and 5 of the drawing in greater detail, and a plurality of straight segments, each denoted generally for ease of reference in FIG. 2 of the drawing by the same reference numeral 32, that will be described hereinafter with reference to FIGS. 6, 7 and 8 of the drawing in greater detail. In addition to the base segment 30 and the plurality of straight segments 32 to which reference has been had above, the first embodiment of segmented smelt spout 12 also includes a tensioning means, denoted generally in FIG. 2 of the drawing by the reference numeral 34, to which further reference will be had hereinafter. However, suffice it to say for now that the tensioning means 34 is operative for the purpose of holding the plurality of straight segments 32 and the base segment 30 together while at the same time permitting the plurality of straight segments 32 and the base segment 30 to expand and contract thermally.

Figure 2:
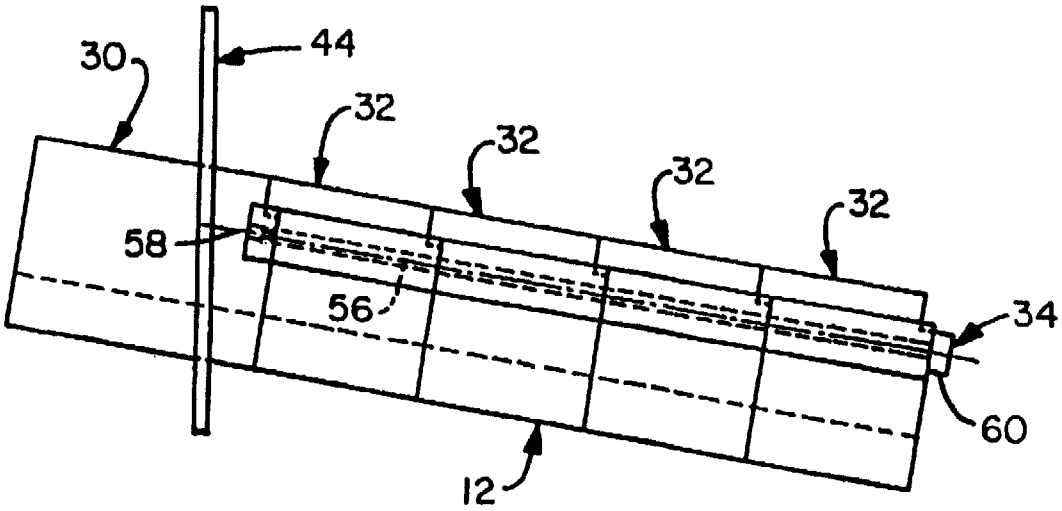
FIG. 2 is a side elevational view of a first embodiment of a segmented smelt spout illustrated therein as consisting of a base segment and a plurality of straight segments, constructed in accordance with the present invention.
Figure 4:
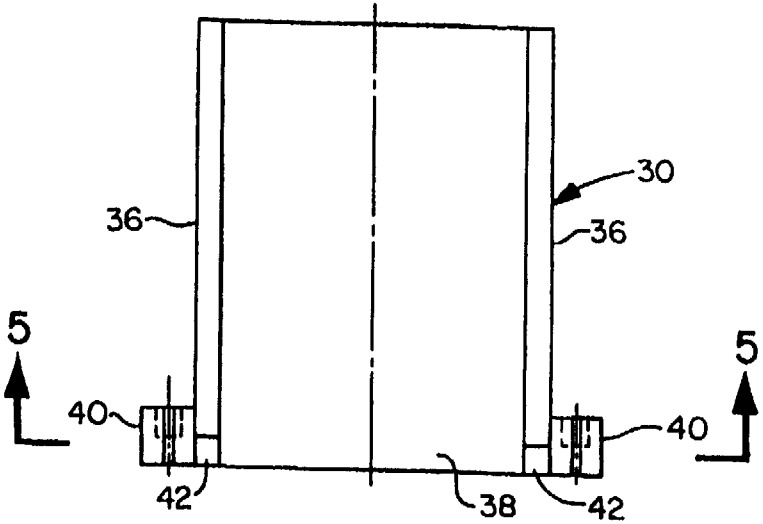
FIG. 4 is a plan view of the base segment of the first embodiment of a segmented smelt spout illustrated in FIG. 2, constructed in accordance with the present invention.
Figure 5:
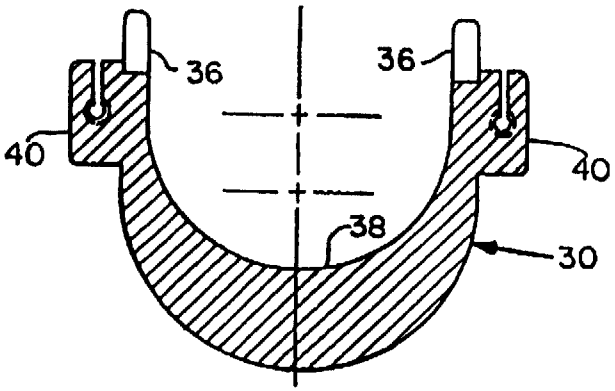
FIG. 5 is a partial sectional view of the base segment of the first embodiment of a segmented smelt spout illustrated in FIG. 2, constructed in accordance with the present invention, taken substantially along the line 5—5 in FIG. 4.
Figure 3:
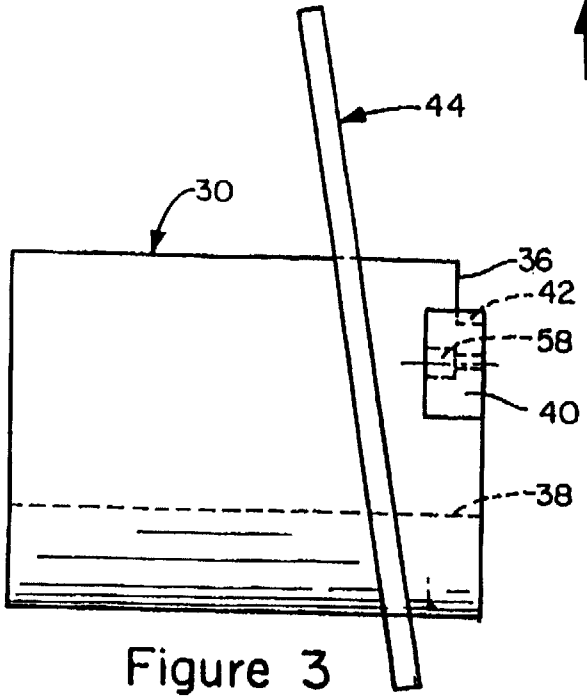
FIG. 3 is a side elevational view of the base segment of the first embodiment of a segmented smelt spout illustrated in FIG. 2, constructed in accordance with the present invention.

Continuing with the description of the first embodiment of segmented smelt spout 12 that is depicted in FIG. 2 of the drawing, a description will next be had herein of the base segment 30 thereof. For purposes of this description of the base segment 30 reference will be had in particular to FIGS. 3 through 5 of the drawing. As best understood with reference to FIG. 5 of the drawing, the base segment 30 embodies a substantially U-shaped configuration. To this end, the base segment 30 embodies a pair of upstanding leg portions, each such upstanding leg portion being denoted for ease of reference by the same reference numeral 36 in the drawing, and a trough-like portion, denoted in the drawing by the reference numeral 38, of varying thickness. In accord with the best mode embodiment of the invention, the base segment 30 is formed as an integral member, i.e., the upstanding leg portions are formed integral with the trough-like portion 38. For a purpose that will be described herein subsequently, each of the upstanding leg portions 36, as can be seen with reference in particular to FIG. 4 of the drawing, terminates at one longitudinally extending end thereof in a lug, each such lug being denoted for ease of reference by the reference numeral 40 in the drawing. Each of the upstanding leg portions 36 at the longitudinally extending end thereof is further provided in adjoining relation to the respective one of the lugs 40, which is located thereat, with a mating, i.e., complementary, surface, each such mating surface being denoted for ease of reference by the same reference numeral 42 in the drawing, for a purpose that will be described herein subsequently. More specifically, in accord with the best mode embodiment of the invention each such mating surface, as will be best understood with reference to FIGS. 3 and 4 of the drawing, preferably comprises a notch, which is suitably dimensioned so as to be operative as a mating surface, that is formed in each of the upstanding leg portions 36 at the same longitudinally extending end thereof as that whereat a lug 40 is provided.

Completing herein the description of the base segment 30, the base segment 30 is operative for purposes of effecting therewith the mounting of a segmented smelt spout, constructed in accordance with the present invention, in installed relation relative thereto in one of the walls of a chemical recovery unit, such as the chemical recovery unit 10 illustrated in FIG. 1 wherein the segmented smelt spout 12 is depicted mounted in installed relation relative thereto in the chemical recovery unit 10. For purposes of effecting such mounting of a segmented smelt spout, constructed in accordance with the present invention, in accordance with the best mode embodiment of the invention a mounting means, such as that illustrated schematically in FIGS. 2 and 3 of the drawing, wherein the mounting means is denoted generally by the reference numeral 44, is preferably cooperatively associated with the base segment 30. The mounting means 44 may take the form of any conventional type of mounting means that is suitable for use for the purpose of effecting therewith the mounting of the base segment 30 and thereby concomitantly therewith a segmented smelt spout 12 and 12', constructed in accordance with the present invention, in installed relation relative thereto in a chemical recovery unit.

Figure 7:
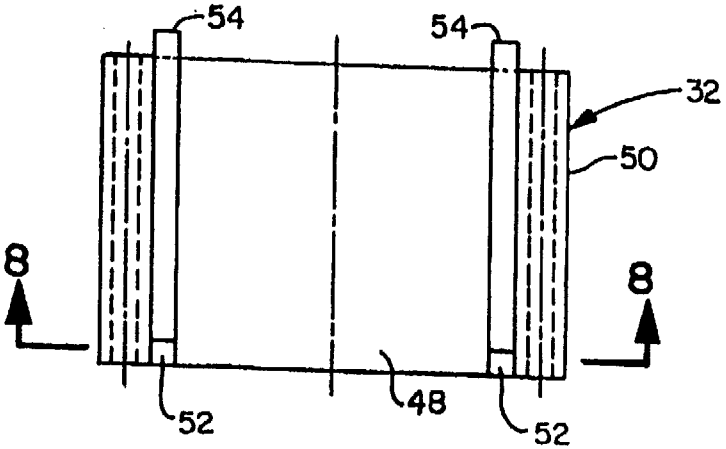
FIG. 7 is a plan view of one of the plurality of straight segments of the first embodiment of a segmented smelt spout illustrated in FIG. 2, constructed in accordance with the present invention.
Figure 8:
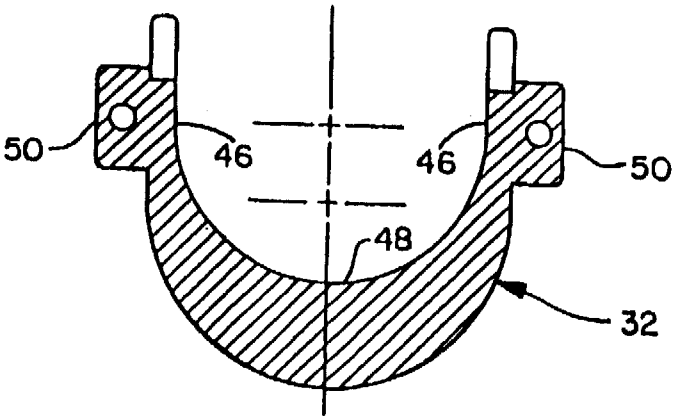
FIG. 8 is a partial sectional view of one of the plurality of straight segments of the first embodiment of a segmented smelt spout illustrated in FIG. 2, constructed in accordance with the present invention, taken substantially along the line 8—8 in FIG. 7.
Figure 6:
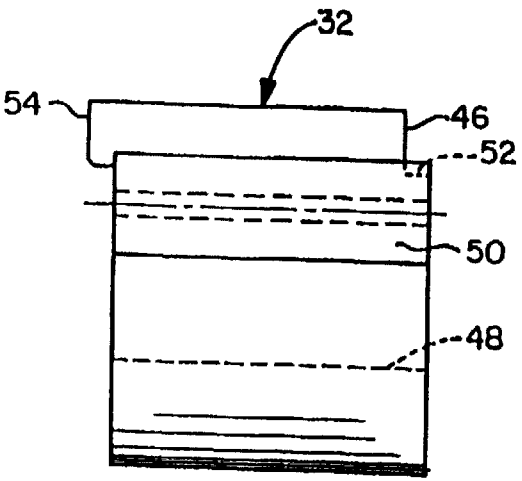
FIG. 6 is a side elevational view of one of the plurality of straight segments of the first embodiment of a segmented smelt spout illustrated in FIG. 2, constructed in accordance with the present invention.

With further reference to the segmented smelt spout 12, next there will be set forth herein a description of the plurality of straight segments 32 thereof. Since each of the plurality of straight segments 32 is identical both insofar as the nature of the construction and the mode of operation thereof is concerned, it is deemed to be sufficient to set forth hereinafter a description of only one such straight segment 32. Reference will be had in particular to FIGS. 6, 7 and 8 of the drawing in connection with the description hereinafter of one such straight segment 32.

To this end, as best understood with reference to FIG. 8 of the drawing, each of the plurality of straight segments 32 embodies a pair of longitudinally extending upstanding leg portions, each such longitudinally extending upstanding leg portion being denoted for ease of reference by the same reference numeral 46 in the drawing, and a longitudinally extending trough-like portion, denoted in the drawing by the reference numeral 48, of varying thickness. In accord with the best mode embodiment of the invention, each of the plurality of straight segments 32 is formed as an integral member, i.e., the longitudinally extending upstanding leg portions 46 of each of the plurality of straight segments 32 are formed integral with the longitudinally extending trough-like portion 48 thereof. For a purpose that will be described herein subsequently, each of the longitudinally extending upstanding leg portions 46 of each of the plurality of straight segments 32, as will be best understood with reference to FIG. 7 of the drawing, is provided with a protuberance, each such protuberance being denoted for ease of reference by the same reference numeral 50 in the drawing, formed integrally therewith so as to project outwardly therefrom and so as to extend for the full length thereof. Each of the longitudinally extending upstanding leg portions 46 of each of the plurality of straight segments 32 is further provided at each end thereof in adjoining relation to the protuberance 50 thereof that extends longitudinally the full length of each of the longitudinally extending upstanding leg portion 46 of each of the plurality of straight segments 42 with a mating surface. More specifically, in accord with the best mode embodiment of the invention one such mating surface at one end of each of the longitudinally extending upstanding leg portions 46 of each of the plurality of straight segments 32, as will be best understood with reference to FIGS. 6 and 7 of the drawing, preferably comprises a notch, each such notch for ease of reference being denoted by the same reference numeral 52 in the drawing, which is suitably dimensioned so as to be operative as a mating surface in the manner described hereinafter. Whereas the other such mating surface at the other end of each of the longitudinally extending upstanding leg portions 46 of each of the plurality of straight segments 32, in accord with the best mode embodiment of the invention and as will be best understood with reference to FIGS. 6 and 7 of the drawing, preferably comprises a projection, each such projection for ease of reference being denoted by the same reference numeral 54 in the drawing, which is suitably dimensioned so as to be operative as a mating surface in the manner described hereinafter. Namely, the notches 52 and the projections 54 of each of the plurality of straight segments 32 are suitably dimensioned so that when a pair of straight segments 32 are positioned in abutting engagement one with another so that the pair of straight segments 32 bear an assembled relation one to the other, the projections 54 of one of the pair of straight segments 32 are received in the notches 52 of the other of the pair of straight segments 32 in order to thereby effect therewith an interconnection between the pair of straight segments 32. Similarly, the projections 54 of each of the plurality of straight segments 32 are suitably dimensioned so that when a straight segment 32 is positioned in abutting engagement with the base segment 30 so that the straight segment 32 and the base segment 30 bear an assembled relation one to the other, the projections 54 of the straight segment 32 are received in the notches 42 of the base segment 30 in order to thereby effect therewith an interconnection between the straight segment 32 and the base segment 30. To thus summarize, the notches 42 of the base segment 30 as well as the notches 52 and the projections 54 of the straight segment 32 are each suitably dimensioned so that the projections 54 of each of the straight segments 32 are complementary to the notches 42 of the base segment 30 as well as to the notches 52 of any other straight segment 32.

Continuing with the description of the segmented smelt spout 12, constructed in accordance with the present invention and as illustrated in FIG. 2 of the drawing, there will now be set forth herein a description of the tensioning means 34 thereof. For this purpose, reference will be had in particular to FIG. 2 of the drawing. Thus, as best understood with reference to FIG. 2 of the drawing, the tensioning means 34, in accord with the best mode embodiment of the invention, preferably comprises a pair of tension cables, only one of which is visible in FIG. 2 of the drawing wherein the tension cable that is visible in FIG. 2 is denoted therein by the reference numeral 56. Each of the tension cables 56 is designed so as to be both expandable and contractible for a purpose that will be discussed more fully hereinafter, and as such are each formed of a conventional type of material that is suitable for use for the purpose of enabling the tension cable 56 to function in the aforedescribed manner, i.e., to expand and contract. Although not depicted in the drawing in the interest of maintaining clarity of illustration therein, it is to be understood that each of the tension cables 56 at one end thereof is preferably provided with a protruding portion, i.e., head, (not shown). This protruding portion, i.e., head, (not shown) of each of the tension cables 56 is suitably dimensioned so as to be capable of being received with a sliding fit in a countersunk hole, denoted in FIGS. 2 and 3 of the drawing by the reference numeral 58, which is provided in each of the lugs 40 of the base segment 30 for this purpose, i.e., to receive therewithin the protruding portion, i.e., head, (not shown) of a tension cable 56. The other end of each of the tension cables 56 is suitably designed so as to be capable of having positioned thereon in secured relation thereto a suitable fastening member, such as the fastening member denoted by the reference numeral 60 in FIG. 2. Any conventional type of fastening member suitable for use for the purpose of effecting therewith the securing in place of a tension cable 56 relative to the base segment 30 and the plurality of straight segments 32 may be utilized as the fastening member 60 for the tension cable 56.

The function of the tensioning means 34, as has been previously alluded to herein, is to hold the base segment 30 and the plurality of straight segments 32 of the segmented smelt spout 12 together in assembled relation such that as best understood with reference to FIG. 2 of the drawing the mating surfaces thereof are maintained in contact with one another while at the same time permitting the base segment 30 and the individual ones of the plurality of straight segments 32 of the segmented smelt spout 12 to expand and contract thermally relative to each other. Namely, as best understood with reference to FIG. 2 of the drawing, when the segmented smelt spout 12 is in its assembled condition, the base segment 30 and the plurality of straight segments 32 thereof are secured in abutting engagement with one another by means of the tensioning means 34. To this end, each of the tension cables 56 of the tensioning means 34 is positioned in a longitudinally extending opening suitably provided for this purpose in each of the lugs 40 of the base segment 30 as well as in a longitudinally extending opening that is suitably provided for this purpose in each of the longitudinally extending upstanding leg portions 46 of each of the plurality of straight segments 32 such that the protruding portion, i.e., head, (not shown) provided at one end of each of the tension cables 56 is received in a respective one of the countersunk holes 58 with which each of the lugs 40 of the base segment 30 is suitably provided, and with the fastening member 60 being positioned on the other end of each of the tension cables 56 so as to be operative to effect therewith the securing of each of the tension cables 56 in place and thereby concomitantly maintaining in assembled relation one to another the base segment 30 and the plurality of straight segments 32, which collectively comprise the segmented smelt spout 12.

Depending upon the relative coefficients of thermal expansion of the tension cables 56 and the spout segments 30, 32, it is conceivable that differential expansion between the tension cables and the spout segments could result in excessive tensile forces arising in the cables. For example, since they are directly contacted by the smelt, the segments of the spout could become much hotter than the tension cables, and unless compensated for, excessive forces could arise which, since they are in addition to the pre-tension load of the cables 56 could exceed the working limit of the cables. To avoid this, the cables 56 incorporate a compensating device (not shown) in the form of a spring arrangement which is designed to yield resiliently so as to absorb overload tensile forces induced by differential thermal expansion forces, and thus protect the tensile cables 56 and their mountings from damage. Various spring devices can be used for this purpose, for example one or more belleville spring washers (not shown) positioned between the head at the outer end of the tension cable and the end of the outermost segment of the spout. Whatever spring device is used for this purpose, it will be designed to accommodate a sufficient compression movement as to absorb forces resulting from differential expansion of the components, while maintaining the preset minimum tensile force required to hold the spout segments together under all operating conditions.

Figure 9:
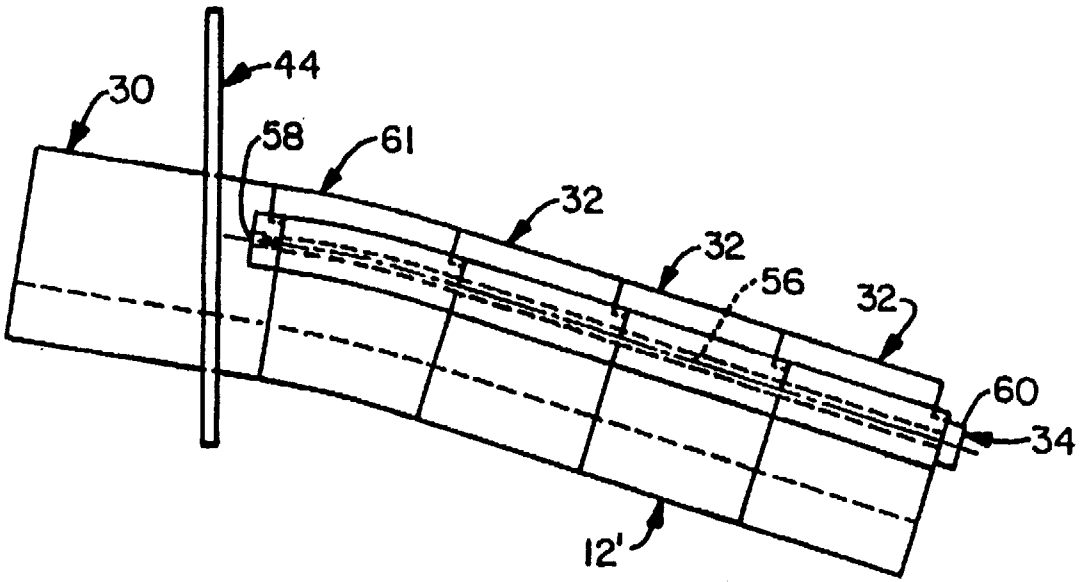
FIG. 9 is a side elevational view of a second embodiment of a segmented smelt spout illustrated therein as consisting of a base segment and a curved segment and a plurality of straight segments, constructed in accordance with the present invention.

There will now be set forth herein a description of the second embodiment of segmented smelt spout 12' illustrated in FIG. 9 of the drawing. As best understood with reference to FIG. 9 of the drawing, the segmented smelt spout 12' like the segmented smelt spout 12, which is illustrated in FIG. 2 of the drawing, comprises an assembly of segments of different shapes. More specifically, like the segmented smelt spout 12, the segmented smelt spout 12' also includes a base segment 30, a plurality of straight segments 32, a tensioning means 34 and has a mounting means 44 cooperatively associated therewith. However, unlike the segmented smelt spout 12, the segmented smelt spout 12' in addition includes also a curved segment, which is denoted in FIG. 9 of the drawing by the reference numeral 61.

Inasmuch as the base segment 30, the plurality of straight segments 32, the tensioning means 34 and the mounting means 44 of the segmented smelt spout 12' are identical to the base segment 30, the plurality of straight segments 32, the tensioning means 34 and the mounting means 44, respectively, of the segmented smelt spout 12 insofar as the nature of the construction thereof and the mode of operation thereof are concerned, it is not deemed necessary in connection with setting forth herein a description of the segmented smelt spout 12', constructed in accordance with the present invention, to again set forth herein either a description of the base segment 30 or a description of the plurality of straight segments 32 or a description of the function that the tensioning means 34 performs relative to the base segment 30 and the plurality of straight segments 32 or a description of the mounting means 44. As such, for purposes of obtaining an understanding of the nature of the construction and the mode of operation of the segmented smelt spout 12', it is deemed to be only necessary to set forth hereinafter a description of the nature of the construction and the mode of operation of the curved segment 61, and a description of the function that the tensioning means 34 performs relative to the curved segment 61.

There will now be set forth herein a description of the curved segment 61. For this purpose, reference will be had in particular to FIGS. 10, 11 and 12 of the drawing. Thus, as best understood with reference to FIGS. 10 and 12 of the drawing, the curved segment 61 embodies a pair of curved, longitudinally extending upstanding leg portions, each such curved, longitudinally extending upstanding leg portion being denoted for ease of reference by the same reference numeral 62 in the drawing, and a longitudinally extending trough-like portion, denoted in the drawing by the reference numeral 64, of varying thickness. In accord with the best mode embodiment of the invention, the curved segment 61 is formed as an integral member, i.e., the curved, longitudinally extending upstanding leg portions 62 of the curved segment 61 are formed integral with the longitudinally extending trough-like portion 64 thereof. For a purpose that will be described herein subsequently, each of the curved, longitudinally extending upstanding leg portions 62 of the curved segment 61, as will be best understood with reference to FIG. 11 of the drawing, is provided with a protuberance, each such protuberance being denoted for ease of reference by the same reference numeral 70 in the drawing, formed integrally therewith so as to project outwardly therefrom and so as to extend for the full length thereof. Each of the curved, longitudinally extending upstanding leg portions 62 of the curved segment 61 is further provided with a mating surface at each end thereof in adjoining relation to the protuberance 70 thereof that extends longitudinally the full length of each of the curved, longitudinally extending upstanding leg portions 62 of the curved segment 61.

Figure 11:
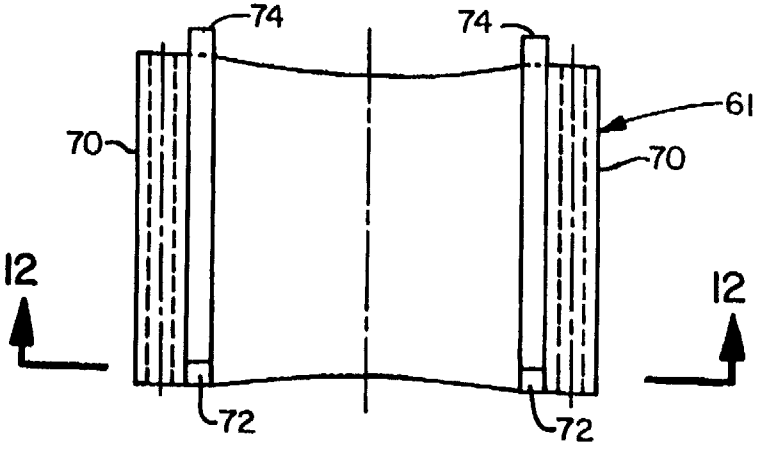
FIG. 11 is a plan view of the curved segment of the second embodiment of a segmented smelt spout illustrated in FIG. 9, constructed in accordance with the present invention.
Figure 12:
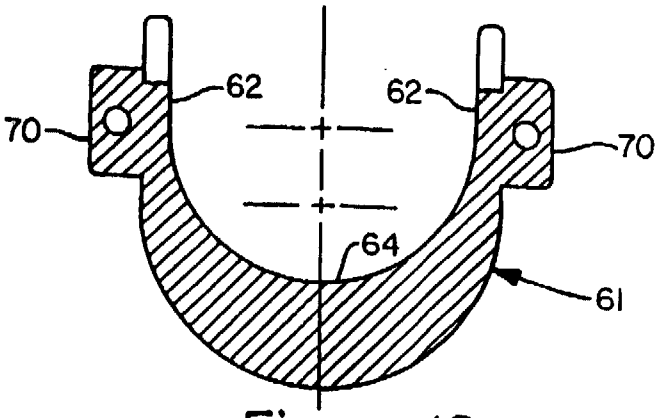
FIG. 12 is a partial sectional view of the curved segment of the second embodiment of a segmented smelt spout illustrated in FIG. 9, constructed in accordance with the present invention, taken substantially along the line 12—12 in FIG. 11.
Figure 10:
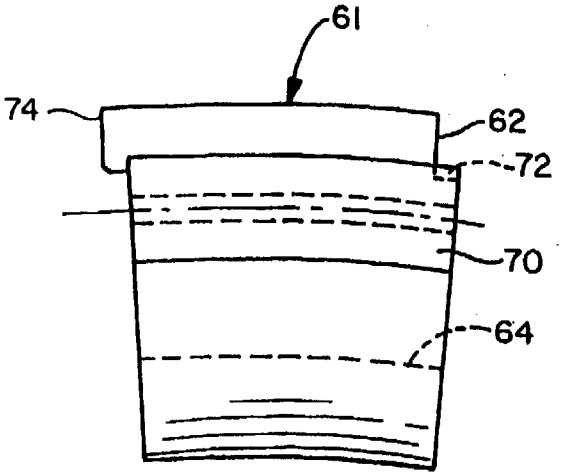
FIG. 10 is a side elevational view of the curved segment of the second embodiment of a segmented smelt spout illustrated in FIG. 9, constructed in accordance with the present invention.

Continuing, in accord with the best mode embodiment of the invention one such mating surface at one end of each of the curved, longitudinally extending leg portions 62 of the curved segment 61, as will be best understood with reference to FIGS. 10 and 11 of the drawing, preferably comprises a notch, each such notch for ease of reference being denoted by the same reference numeral 72 in the drawing, which is suitably dimensioned so as to be operative as a mating surface in the manner described hereinafter. Whereas the other such mating surface at the other end of each of the curved, longitudinally extending upstanding leg portions 62 of the curved segment 61, in accord with the best mode embodiment of the invention and as will be best understood with reference to FIGS. 10 and 11 of the drawing, preferably comprises a projection, each such projection for ease of reference being denoted by the same reference numeral 74 in the drawing, which is suitably dimensioned so as to be operative as a mating surface in the manner described hereinafter. Namely, the notches 72 and the projections 74 of the curved segment 61 are suitably dimensioned so that when the curved segment 61 and a straight segment 32 are positioned in abutting engagement one with another so that the curved segment 61 and the straight segment 32 bear an assembled relation one to another, the projections 54 of the straight segment 32 are received in the notches 72 of the curved segment 61 in order to effect therewith an interconnection between the curved segment 61 and the straight segment 32. Similarly, the projections 74 of the curved segment 61 are suitably dimensioned so that when the curved segment 61 is positioned in abutting engagement with the base segment 30 so that the curved segment 61 and the base segment 30 bear an assembled relation one to the other, the projections 74 of the curved segment 61 are received in the notches 42 of the base segment 30 in order to thereby effect therewith an interconnection between the curved segment 61 and the base segment 30. To thus summarize, the notches 42 of the base segment 30 and the notches 52 and the projections 54 of the straight segments 32 as well as the notches 72 and the projections 74 of the curved segment 61 are each suitably dimensioned so that the projections 54 of the straight segments 32 as well as the projections 74 of the curved segment 61 are complementary to the notches 42 of the base segment 30, the notches 52 of a straight segment 32 as well as the notches 72 of the curved segment 61.

For purposes of completing the description of the segmented smelt spout 12', which is illustrated in FIG. 9 of the drawing, reference will once again be had herein to the tensioning means 34. The tensioning means 34, as has been set forth herein previously includes a pair of tension cables 56, only one of which is visible in FIG. 9 of the drawing. Each of the tension cables 56 also as has been set forth herein previously is provided with a protruding portion, i.e., head (not shown). This protruding portion, i.e., head, (not shown) of each of the tension cables 56 is suitably dimensioned so as to be capable of being received with a sliding fit in the countersunk hole 58, which is provided in each of the lugs 40 of the base segment 30 for this purpose. The other end of each of the tension cables 56 is suitably designed so as to be capable of having positioned thereon in secured relation thereto a suitable fastening member 60.

As has been alluded to herein previously, the function of the tensioning means 34 is to hold the base segment 30, the curved segment 61 and the plurality of straight segments 32 of the segmented smelt spout 12' together in assembled relation such that as best understood with reference to FIG. 9 of the drawing the mating surfaces thereof are maintained in contact with one another while at the same time permitting the base segment 30, the curved segment 61 and individual ones of the plurality of straight segments 32 of the segmented smelt spout 12' to expand and contract thermally relative to each other. To this end, each of the tension cables 56 of the tensioning means 34 is positioned in a longitudinally extending opening suitably provided for this purpose in each of the lugs 40 of the base segment 30 and in a longitudinally extending opening that is suitably provided for this purpose in each of the curved, longitudinally extending upstanding leg portions 70 of the curved segment 61 and in a longitudinally extending opening that is suitably provided for this purpose in each of the longitudinally extending upstanding leg portions 46 of each of the plurality of straight segments 32. With the tension cables 56 so positioned relative to the base segment 30, the curved segment 61 and the plurality of straight segments 32, the protruding portion, i.e., head, (not shown) provided at one end of each of the tension cables 56 is received in a respective one of the countersunk holes 58 with which each of the lugs 40 of the base segment 30 is suitably provided and the fastening member 60 is positioned on the other end of each of the tension cables 56 so as to be operative to effect therewith the securing of each of the tension cables 56 in place and thereby concomitantly maintaining in assembled relation one to another the base segment 30, the curved segment 61 and the plurality of straight segments 32, which collectively comprise the segmented smelt spout 12'.

In accord with the best mode embodiment of the segmented smelt spout 12 and 12', constructed in accordance with the present invention, the base segment 30, the curved segment 61 and the individual ones of the plurality of straight segments 32 preferably each comprise castings each consisting of a nickel/chrome alloy that is suitable for use for such a purpose, whereby the respective upstanding leg portions and the respective trough-like portion thereof are formed integrally with each other. Moreover, in accord with the best mode embodiment of the segmented smelt spout 12 and 12', constructed in accordance with the present invention, although the base segment 30 is described hereinabove and is illustrated in the drawing as being provided with mating surfaces that consist of a pair of notches 42, it is to be understood that the base segment 30 without departing from the essence of the present invention could be provided with mating surfaces that consist of only one notch 42 and with the other notch 42 thereof being replaced with a projection similar in configuration and in dimensions to the projections 54 of the straight segments 32 and the projections 74 of the curved segment 61. Furthermore, if the base segment 30 were to be provided with mating surfaces consisting of one notch 42 and one projection, then each of the plurality of straight segments 32 without departing from the essence of the present invention could be provided with mating surfaces wherein rather than having both notches 52 thereof being provided at the same end thereof and both projections 54 thereof being provided at the same end thereof would be provided at each end thereof with one notch 52 and one projection 54. Likewise, if the base segment 30 were to be provided with mating surfaces consisting of one notch 42 and one projection, then the curved segment 61 without departing from the essence of the present invention could be provided with mating surfaces wherein rather than having both notches 72 thereof being provided at the same end thereof and both projections 74 thereof being provided at the same end thereof would be provided at each end thereof with one notch 72 and one projection 74.

From the preceding description thereof and the illustration thereof in the drawing, it should now be readily apparent that the segmented smelt spout, constructed in accordance with the present invention, comprises an assembly of cast segments of different shapes, which can be used in different combinations to obtain varying smelt spout angles and varying smelt spout lengths. In this regard, by way of example and not limitation, the segmented smelt spout constructed in accordance with the present invention, for example, may be comprised of a base segment 30 and four individual straight segments 32 so as to extend at a first preestablished angle relative to the horizontal and for a first preestablished length, as does the segmented smelt spout 12, which is illustrated in FIG. 2 of the drawing of the instant application. On the other hand, the segmented smelt spout constructed in accordance with the present invention, for example, may be comprised of a base segment 30, a curved segment 61 and three individual straight segments 32 so as to extend at a second preestablished angle relative to the horizontal and for a second preestablished length, as does the segmented smelt spout 12', which is illustrated in FIG. 9 of the drawing of the instant application. Therefore, in summary, it should thus be apparent that the length of the segmented smelt spout constructed in accordance with the present invention, generally speaking, is established by the number of individual straight segments 32 that a particular segmented smelt spout, constructed in accordance with the present invention, embodies. Whereas, the angle at which the segmented smelt spout, constructed in accordance with the present invention, extends relative to the horizontal, generally speaking, is established by the number of curved segments 61 that a particular segmented smelt spout, constructed in accordance with the present invention, embodies.

Thus, in accordance with the present invention there has been provided a new and improved smelt spout suitable for use to effect therewith the delivery of smelt from a chemical recovery unit. Moreover, there has been provided in accord with the present invention such a new and improved smelt spout that is characterized in that the smelt spout is non-cooled so as to thereby obviate any potential safety hazard that might be occasioned by virtue of the smelt coming into contact with a cooling medium, such as water that might be being used to effect therewith the cooling of the smelt spout. Besides, in accordance with the present invention there has been provided such a new and improved smelt spout that is characterized in that the nature of the construction, which the smelt spout possesses, provides for flexibility insofar as the selection of the spout angle is concerned. As well, there has been provided in accord with the present invention such a new and improved smelt spout that is characterized in that the nature of the construction, which the smelt spout possesses, provides for flexibility insofar as the selection of the length of the smelt spout is concerned. Further, in accordance with the present invention there has been provided such a new and improved smelt spout that is characterized in that the nature of the construction, which the smelt spout possesses, provides for the smelt spout to be composed of relatively small pieces in order to thereby facilitate the handling thereof during installation of the smelt spout in a chemical recovery unit. Furthermore, there has been provided in accord with the present invention such a new and improved smelt spout that is characterized in that the nature of the construction, which the smelt spout possesses, provides for selective replacement of portions of the smelt spout, such as those, for example which are subjected to the highest wear, without necessitating that the entire smelt spout be replaced in order to effect the replacement of such portions of the smelt spout. Also, in accordance with the present invention there has been provided such a new and improved smelt spout that is characterized in that the nature of the construction, which the smelt spout possesses, provides for the smelt spout to be composed of a plurality of segments, each being relatively short in length for the purpose of being able to better handle the thermal gradients, which are experienced particularly between the inner and outer surfaces of the thickest portions of the smelt spout that are in contact with the smelt flow. Additionally, there has been provided in accord with the present invention such a new and improved smelt spout that is characterized in that the nature of the construction, which the smelt spout possesses, is such that the smelt spout is suitable for incorporation as part of a new chemical recovery unit. Penultimately, in accordance with the present invention there has been provided such a new and improved smelt spout that is characterized in that the nature of the construction, which the smelt spout possesses, is such that the smelt spout is suitable for retrofitting into existing chemical recovery units while at the same time still being suitable for incorporation as part of a new chemical recovery unit. Finally, there has been provided in accord with the present invention such a new and improved smelt spout that is characterized in that the nature of the construction, which the smelt spout possesses, is such that the smelt spout is easy to employ, is reliable in operation, but which is relatively inexpensive to provide.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. A segmented smelt spout installable in a chemical recovery unit and when so installed operable for the purpose of effecting therewith the discharge from the chemical recovery unit of smelt that is produced during the course of the operation of the chemical recovery unit comprising:

a. a plurality of segments of varying shapes capable of being employed in different combinations in order to thereby provide through the use thereof various smelt spout angles and various smelt spout lengths, said plurality of segments of varying shapes including a first segment embodying a first shape and at least one second segment embodying a second shape, said first segment including a pair of longitudinally extending upstanding leg portions and a longitudinally extending trough portion, at least one of said pair of longitudinally extending upstanding leg portions of said first segment including at one end thereof a mating surface having a particular configuration, said second segment including a pair of longitudinally extending upstanding leg portions and a longitudinally extending trough portion, each of said pair of longitudinally extending upstanding leg portions of said second segment including at one end thereof at least one mating surface having a particular configuration, said particular configuration of said at least one mating surface of said at least one of said pair of longitudinally extending upstanding leg portions of said second segment at one end of said second segment being complementary to said particular configuration of said one mating surface of said at least one of said pair of longitudinally extending upstanding leg portions of said first segment in order to thereby enable an interconnection to be effected therebetween when said first segment and said second segment are positioned in abutting engagement one with another;

b. tensioning means operable for holding said first segment and said second segment together in assembled relation when said first segment and said second segment are positioned in abutting engagement one with another while concomitantly permitting both said first segment and said second segment to expand and contract thermally; and c. mounting means cooperatively associated with said first segment and operable for effecting therewith the installation of the segmented smelt spout in a chemical recovery unit.

2. The segmented smelt spout as set forth in claim 1 wherein said first segment includes a pair of lugs, each of said pair of lugs being provided at one end of said first segment in juxtaposed relation to one of said pair of longitudinally extending upstanding leg portions of said first segment.

3. The segmented smelt spout as set forth in claim 2 wherein each of said pair of longitudinally extending leg portions of said first segment includes at one end thereof a mating surface having a particular configuration.

4. The segmented smelt spout as set forth in claim 3 wherein said mating surface of each of said pair of longitudinally extending leg portion of said first segment comprises a notch.

5. The segmented smelt spout as set forth in claim 1 wherein said plurality of segments of varying shapes includes a plurality of said second segments.

6. The segmented smelt spout as set forth in claim 5 wherein said one of said mating surfaces of each of said pair of longitudinally extending upstanding leg portions of said plurality of second segments comprises a projection.

7. The segmented smelt spout as set forth in claim 5 wherein said other one of said mating surfaces of said pair of longitudinally extending upstanding leg portions of said plurality of second segments comprises a notch.

8. The segmented smelt spout as set forth in claim 1 wherein said plurality of segments of varying shapes further includes a third segment embodying a third shape.

9. The segmented smelt spout as set forth in claim 8 wherein said one of said mating surfaces of each of said pair of curved longitudinally extending upstanding leg portions of said third segment comprises a projection.

10. The segmented smelt spout as set forth in claim 8 wherein said other one of said mating surfaces of each of said pair of curved longitudinally extending upstanding leg portions of said third segment comprises a notch.

11. The segmented smelt spout as set forth in claim 8 wherein said tensioning means includes a pair of tension cables and a fastening member positioned on each of said pair of tension cables.

12. The segmented smelt spout as set forth in claim 11 wherein one of said pair of tension cables is operatively connected to each of said pair of longitudinally extending upstanding leg portions of said first segment and to each of said pair of longitudinally extending upstanding leg portions of said at least one second segment and to each of said pair of curved longitudinally extending upstanding leg portions of said third segment.

13. The segmented smelt spout as set forth in claim 4 wherein each of said plurality of said second segments includes a pair of longitudinally extending upstanding leg portions and a longitudinally extending trough portion, each of said pair of longitudinally extending upstanding leg portions of each of said plurality of second segments including at each end thereof a mating surface having a particular configuration, said particular configuration of one of said mating surfaces of each of said pair of longitudinally extending upstanding leg portions of said plurality of second segments being complementary to said particular configuration of said at least one mating surface of said at least one of said pair of longitudinally extending upstanding leg portions of said first segment and said particular configuration of the other one of said mating surfaces of each of said pair of longitudinally extending upstanding leg portions of said plurality of second segments being the same as said particular configuration of said at least one mating surface of said at least one of said pair of longitudinally extending upstanding leg portions of said segment.

14. The segmented smelt spout as set forth in claim 7 wherein said third segment includes a pair of curved longitudinally extending upstanding leg portions and a longitudinally extending trough portion, each of said pair of curved longitudinally extending leg portions of said third segment including at one end thereof a mating surface having a particular configuration, said particular configuration of one of said mating surfaces of each of said pair of curved longitudinally extending upstanding leg portions of said third segment being complementary to said particular configuration of said at least one mating surface of said at least one of said pair of longitudinally extending upstanding leg portions of said first segment and said particular configuration of the other one of said mating surfaces of each of said pair of curved longitudinally extending upstanding leg portions of said third segment being the same as said particular configuration of said at least one mating surface of said at least one of said pair of longitudinally extending upstanding leg portions of said first segment.

* * * * *

UNITED STATES PATENT AND TRADEMARK OFFICE

CERTIFICATE OF CORRECTION

PATENT NO. : 5,800,773

DATED : September 1, 1998

INVENTOR(S) : Christopher J. Beveridge and Andrew K. Jones

It is certified that error appears in the above-identified patent and that said Letters Patent is hereby corrected as shown below:

Claim 6, line 1, "claim 5" should be --claim 13--.

Claim 7, line 1, "claim 5" should be --claim 13--.

Claim 9, line 1, "claim 8" should be --claim 14--.

Claim 10, line 1, "claim 8" should be --claim 14--.

Claim 13, line 1, "claim 4" should be --claim 5--.

Claim 14, line 1, "claim 7" should be --claim 8--.

Signed and Sealed this

Fifteenth Day of December, 1998

Bruce Lehman

*Attest:*

BRUCE LEHMAN

*Attesting Officer*

*Commissioner of Patents and Trademarks*